United States Patent [19]

MacDonald

[11] 4,431,085

[45] Feb. 14, 1984

[54] METHOD OF OPERATING AN ELEVATOR SYSTEM

[75] Inventor: Robert C. MacDonald, West Caldwell, N.J.

[73] Assignee: Westinghouse Electric Corp., Pittsburgh, Pa.

[21] Appl. No.: 324,363

[22] Filed: Nov. 24, 1981

[51] Int. Cl.[3] ..... B66B 1/18

[52] U.S. Cl. ..... 187/29 R

[58] Field of Search ..... 187/29

[56] References Cited

U.S. PATENT DOCUMENTS 1,967,832 7/1934 Lindquist ..... 187/29

4,037,688 7/1977 Winkler ..... 187/29

*Primary Examiner*—J. V. Truhe

*Assistant Examiner*—W. E. Duncanson, Jr.

*Attorney, Agent, or Firm*—D. R. Lackey

[57] ABSTRACT

A new and improved method of serving calls for elevator service in a building. The method independently serve at least two groups of floors using at least two banks of elevator cars, from a single system processor. The full strategy of the system processor is applied to each group as a whole, and not as segments of a strategy, to improve elevator service to each group, while effecting the economies which result from the utilization of a single system processor, a single hall call processor, and a single data transmission system.

5 Claims, 11 Drawing Figures

ZONE CODE
| BOTTOM GROUP | | | | TOP GROUP | | | |
|---|---|---|---|---|---|---|---|
| CODE | UPSV ZONE | DNSV ZONE | CODE | CODE | UPSV ZONE | DNSV ZONE | CODE |
| 5 | HZ | MZD | 6 | 7 | TE | TE | 7 |
| 4 | LZ | | | 8 | HZ | MZD | 9 |
| | | | | 3 | LZ | | |
| 2 | MF | MF | 2 | 2 | MF | MF | 2 |
| 1 | B | B | 1 | 1 | B | B | 1 |
| 0 | —NO ASSIGNMENT— | | 0 | 0 | —NO ASSIGNMENT— | | 0 |
FIG.2
FIG.3
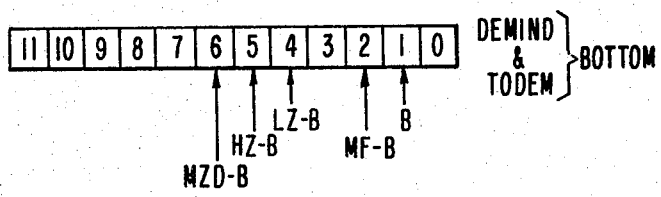
FIG.4
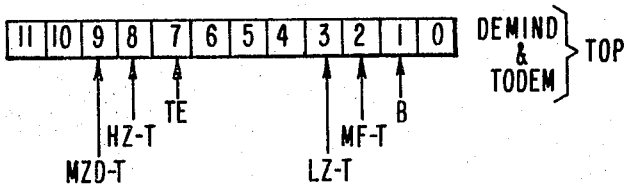

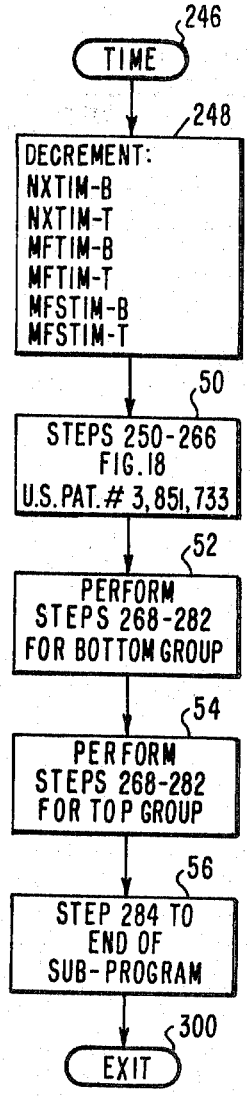
FIG. 5
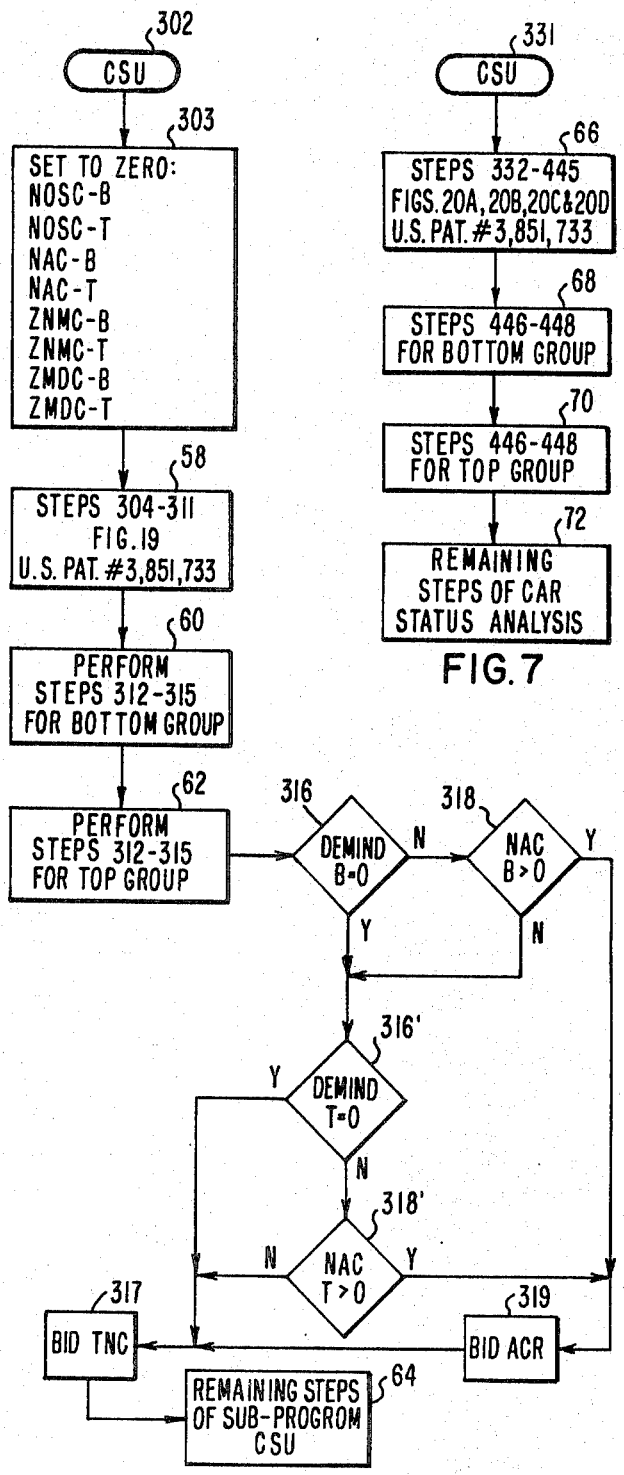
FIG. 6
FIG. 7

METHOD OF OPERATING AN ELEVATOR SYSTEM

BACKGROUND OF THE INVENTION

1. Field of the Invention

The invention relates in general to elevator systems, and more specifically to methods of improving the elevator service in a building having a plurality of elevator cars under group supervisory control.

2. Description of the Prior Art

Elevator systems which have several elevator cars usually include a system processor which controls the movement of the cars to serve calls for elevator service according to a predetermined strategy. U.S. Pat. No. 3,851,733, which is assigned to the same assignee as the present application, sets forth an example of such a strategy. This strategy, for example, may divide the building into low and high zones, for serving up hall calls, and the down hall calls may be treated as a single down zone. In addition to the system processor, the hall calls placed at the floors are directed to, and processed in, suitable hall call control, which may include a hall call memory, and a multiplexer for serializing the calls, and a de-multiplexer for de-multiplexing serial hall call resets. Suitable data transmission hardware links the hall call control and the system processor. The per-car apparatus includes a car controller, which includes the hardware for interfacing with the system processor, a car station, which includes the car call push buttons, a floor selector, a speed pattern generator, and a motor controller.

It would be desirable to improve the elevator service in such an elevator system, if such improvement can be incorporated without a significant increase in the system apparatus, or a major change in the operating strategy.

SUMMARY OF THE INVENTION

Briefly, the present invention is a new and improved method of operating an elevator system, which, in effect, divides a building into first and second independent buildings, with the stategy which would normally be applied to the building as a whole, being applied independently to each section of the building. Further, this change is made without increasing the system hardware.

More specifically, a building is divided into first and second groups of floors, with certain of the elevator cars being part of a first bank assigned or dedicated to serve only the first group, and with the remaining elevator cars being assigned or dedicated to serve only the second group. In a preferred embodiment of the invention, the first and second groups of floors are bottom and top groups, which include certain lower and upper floors, respectively, of the building. The main floor would be common to both groups of floors.

While the full strategy of the system processor is applied independently to each of the first and second groups, no significant increase in system apparatus is required. The strategy of the system processor is applied to each floor group, without the necessity of providing a second system processor, as certain changes are incorporated into the system processor strategy which enables it to match the calls of the floor groups with the appropriate bank of elevator cars. Further, all hall calls are processed in the same hall call control, eliminating the need for a second one of such controls, and also eliminating the need for the additional data communication hardware which would otherwise be required.

Elevator service is improved because the number of special zones in the building have been increased without any significant change in the stategy. For example, if the call answering strategy included a single main down zone, the new method would independently apply the main zone down strategy to each of the first and second groups, just as if each group were in a separate building.

BRIEF DESCRIPTION OF THE DRAWINGS

The invention may be better understood, and further advantages and uses thereof more readily apparent, when considered in view of the following detailed description of exemplary embodiments, taken with the accompanying drawings in which:

FIG. 2 is a diagrammatic representation of a zone code which may be used to identify hall call locations and service direction, as well as the locations and movements of the various elevator cars, in each of the first and second groups of floors;

FIG. 3 is a diagrammatic representation of a memory word established by the system processor in the random access memory to tabulate system demands in the first or bottom group of floors;

FIG. 4 is a diagrammatic representation of a system demand word, similar to that of FIG. 3, except for the second or top group of floors;

FIG. 5 is a flow chart which illustrates how sub-program TIME of U.S. Pat. No. 3,851,733 may be modified according to the teachings of the invention;

FIG. 6 is a flow chart which illustrates how sub-program CSU of U.S. Pat. No. 3,851,733 may be modified according to the teachings of the invention;

FIG. 7 is a flow chart which illustrates how the "car status update" portion of sub-program CSU of U.S. Pat. No. 3,851,733 may be modified according to the teachings of the invention;

DESCRIPTION OF PREFERRED EMBODIMENTS

U.S. Pat. Nos. 3,750,850; 3,804,209 and 3,851,733, which are assigned to the same assignee as the present application, collectively set forth an elevator system which may be modified according to the teachings of the invention, and these patents are hereby incorporated into the present application by reference. U.S. Pat. No. 3,750,850 sets forth per-car control, U.S. Pat. No. 3,804,209 sets forth the hardware for operating a plurality of elevator cars under group control and U.S. Pat.

No. 3,851,733 sets forth the stategy in software form for operating a plurality of elevator cars under group control. While the invention will be described relative to this specific elevator system, the invention applies broadly to any elevator system having a plurality of cars under the control of a system processor.

Figure 1:
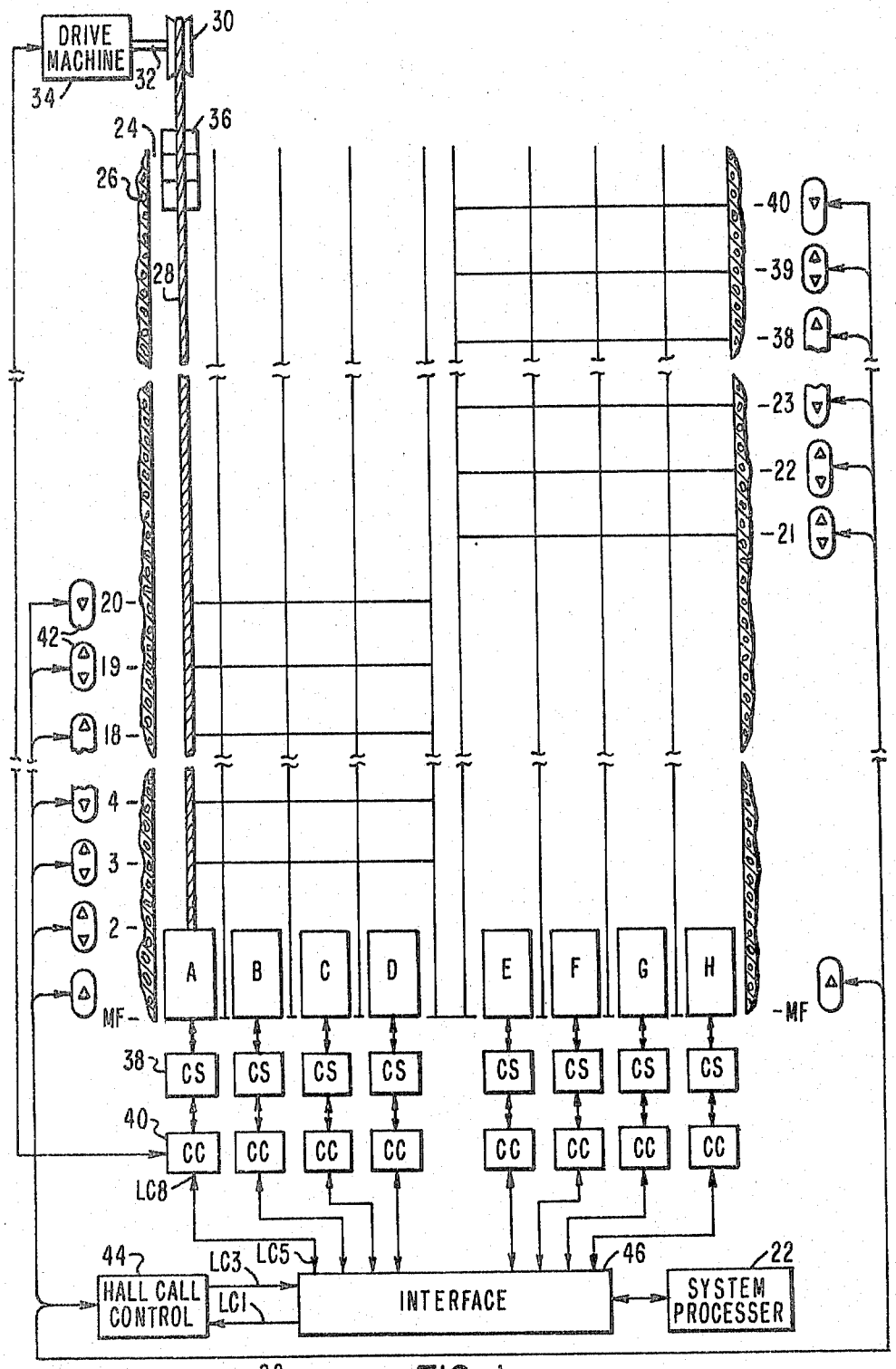
FIG. 1 is a diagrammatic view of an elevator system which may be constructed according to the teachings of the invention.

Referring now to the drawings, and to FIG. 1 in particular, there is shown an elevator system 20 having a plurality of elevator cars A through H, the movement of which is controlled by a single system processor 22 according to a predetermined strategy. Since each of the elevator cars and their controls may be similar, only car A will be described in detail.

More specifically, car A is mounted in a hoistway 24 relative to a building 26, having a plurality of floors or landings, such as forty. Car A is supported by a plurality of wire ropes 28 which are reeved over a traction sheave 30 mounted on the shaft 32 of a drive machine 34. The drive machine includes a drive motor, which may be AC or DC, as desired. A counterweight 36 is connected to the remaining ends of the ropes 28.

Car calls, as registered by a push button array which is part of a car station 38, are recorded and serialized and directed to car control 40. Car control 40 includes car call reset control, a floor selector, a speed pattern generator, motor controller, and such auxiliary controls as the door controller and the hall lantern control.

Hall calls, as registered by push buttons mounted in the hallways of the building 26, adjacent to the elevator door openings, such as push buttons 42, are recorded and serialized in hall call control 44. The serialized hall call information is directed to the system processor 22 via an interface 46, as signal LC3. Hall call resets are prepared by the system processor as the hall calls are served, and sent to the hall call control 44, via the interface 46, as signal LC1.

Various status signals are prepared by each car control 40 and sent to the system processor 22, via interface 46, as serial signal LC5. The system processor 22 decides which elevator car is best suited to serve each hall call, and sends command and inhibit signals to the various elevator cars as serial signal LC8.

In the strategy of the incorporated patents, the building is divided into various service zones, including a basement zone B, if there are floors located below the main or lobby floor, and a main floor zone MF. Above the main floor, certain zones are service-direction oriented, including low and high zones LZ and HZ, respectively, for up calls, and a main zone down MZD for down calls. A top extension, if provided, would provide an additional zone TE.

In the present invention, the floors of building 26 are divided into first and second groups of floors, which, in a preferred embodiment, include a bottom group, such as floors 1–20, and a top group, which includes the remaining floors 21–40. The cars A–H are divided into first and second banks for serving the first and second groups, respectively, such as cars A–D in the first bank, and cars E–H in the second bank. The main floor MF is common to both groups of floors and both banks of cars. The main floor would have a separate up push button for each bank of cars. If there are floors below the main floor, i.e., the basement zone B, they may be served by one, or both banks of cars, as desired. If there is a top extension TE, it would be part of the second or top group of floors.

FIG. 2 is a diagrammatic representation of a zone code which may be used by the system processor 22 to identify hall call locations, hall call service direction requests, and locations of the cars in the building. Floors served by both banks, such as the main floor MF and the basement zone B, may use the same code for both banks, as illustrated, or different codes may be used for the main floor MF in the two groups, as well as different codes for the basement zone B in the two groups, depending upon how the software of the elevator system is to be modified.

In general, the invention involves applying the strategy of the system processor 22 to each group of floors independently, resulting in a significant increase in the number of special zones, and thus providing the full dispatching power to each group of floors, as opposed to treating the groups of floors as merely zones of a single stategy. While the two groups of floors are essentially treated as different buildings, economies are effected by utilizing a single system processor 22, a single hall call control 44, and a single data communication system for the hall calls and hall call resets. The only changes required are software changes, which add additional software timers to account for the fact that there are, in effect, a main dispatching floor for each group, and software changes which match the proper floor group with the proper car bank before applying the common call answering strategy. The changes required in the software of U.S. Pat. No. 3,851,733 to effectively serve building 26 as two independent buildings will now be described.

FIGS. 3 and 4 are diagrammatic representations of memory words maintained by the system processor 22 to tabulate the demands in the bottom and top groups of floors, respectively. The strategy first attempts to allocate a hall call to a suitably conditioned busy car, i.e., a car already in the process of serving a call, or calls, for elevator service. The words "suitably conditioned" refer to a car which is enabled to serve the floor of a call, and to a car which is positioned relative to the hall call, with the proper service direction, to serve the call in due course. This portion of the strategy is contaned in a sub-program ACL which is set forth in FIGS. 22A, 22B and 22C of incorporated U.S. Pat. No. 3,851,733.

Failing to so allocate a hall call, a demand is created for the call which is tabulated in demand word DEMIND, as shown in FIGS. 3 and 4. If this demand persists for a predetermined period of time, it becomes a timed-out demand, which is tabulated in a timed-out demand word TODEM, as shown in FIGS. 3 and 4. These words are checked by sub-program ACR, which sub-program is run when there is a registered demand in a floor group, and there is at least one available car, i.e., a non-busy, in-service car, in the associated bank of cars. Sub-program ACR finds the closest one of such available cars to assign to each demand, with the different types of demands being served in a predetermined priority order. Sub-program ACR is set forth in FIGS. 23A and 23B of incorporated U.S. Pat. No. 3,851,733. In addition to modifying sub-programs ACL and ACR, modifications are also made to a sub-program CSU, which maintains the status of each elevator car, and a sub-program TIME, which maintains the system timers. The same reference numerals used in the sub-programs of U.S. Pat. No. 3,851,733 are used in the present application, where applicable, in order to facilitate referral to this incorporated patent.

More specifically, the interrupt executive and the linking of sub-programs, shown in FIGS. 16 and 17, respectively, of the incorporated patent, are essentially unchanged. Step 222 of the linking program shown in FIG. 17 would additionally zero the extra demand word DEMIND, and the extra timed-out demand word TODEM, as well as the additional software timers NEXI and ZCCI, related to the NEXT car, since there will be a NEXT car to leave the main floor MF for each group of floors.

FIG. 5 sets forth certain modifications made to the sub-program TIME, which is set forth in detail in FIG. 18 of the incorporated patent. This sub-program is entered at terminal 246, and step 248 would be modified because it has two sets of main-floor associated timers to decrement, one for each group of floors. Steps 250–266 have been followed without change, as shown generally at 50. Steps 268–282, which are related to the main floor MF, are the processed relative to the bottom group of floors, as shown generally at 52. Then, steps 268–282 are performed relative to the top group of floors, as shown generally at 54. The remainder of the sub-program TIME is then followed to completion, as shown generally at 56.

FIG. 6 sets forth certain modifications made to sub-program CSU, which is set forth in FIG. 19 of the incorporated patent. Step 303 zeroes the counters associated with each floor group, such as the number of cars out of service in the bank which serves the bottom group of floors, which is referenced counter NOSC-B, and the number of cars which are out of service in the bank which serves the top group of floors, which is referred to as counter NOSC-T. Steps 304–311 are then followed, as indicated generally at 58. Steps 312–315 are then followed for the bottom group of floors, as indicated at 60, to determine if a main-floor demand MFD should be registered for the bottom group of floors, and steps 312–315 are then followed for the top group of floors, as indicated at 62, to determine if a main-floor demand MFD should be registered for the top group.

Step 316 checks the demand words shown in FIG. 3 to see if there is a registered demand in the bottom group. If there is, step 318 determines if the associated bank of cars has an available car, i.e., a non-busy, in-service car, which can be assigned to a demand. If there is such an available car, step 319 places sub-program ACR into bid, which will be selected to run according to a predetermined priority set up for the sub-programs by the linking sub-program hereinbefore referred to.

If step 316 finds no demand in the bottom group of floors, or if step 318 finds no available car which can serve such a demand, the program, in step 316' checks the words shown in FIG. 4 to see if there is a demand in the top group of floors. If there is, step 318' checks to see if there is an available car in the associated bank. If there is, step 319 places sub-programs ACR into bid. Step 316' advances to step 317, to place sub-program TNC into bid when it finds no demand in the top group, as does step 318' when it finds no available car capable of serving the top group. Step 319 also advances to step 217. Sub-program TNC tabulates new hall calls. The remaining steps of sub-program CSU are then followed, as indicated generally at 64.

A certain portion of FIG. 19 in the incorporated patent, includes a block labeled "car status analysis", which is expanded in FIGS. 20A, 20B, 20C and 20D of the incorporated patent. FIG. 7 of the present application illustrates a modification made to this car status analysis section of sub-program CSU.

More specifically, steps 332–445 of FIGS. 20A, 20B, 20C and 20D are followed essentially as shown in the incorporated patent, with step 345 incrementing the counter NOSC of the appropriate bank in order to count an out-of-service car. In like manner, steps 411, 413 and 442 increment the counters ZMDC, ZNMC and NAC of the appropriate banks. Counters ZMDC for each blank tabulate the number of cars qualified to answer a main-floor demand MFD for their group of floors, counter ZNMC for each bank tabulates the number of cars located at the main floor, and counter NAC for each bank tabulates the number of in-service cars available (AVAD) for assignment.

Steps 446–448, shown at 68, handle mid-group parking of an elevator car for the bottom group, and these steps are repeated, as indicated at 70, in order to provide the same function for the top group of floors.

The remaining steps are then followed, indicated at 72, with step 455 being sure to check the number of timed-out down calls for the floor group of which the car being checked is associated.

The sub-program TNC shown in FIG. 21 of the incorporated patent is followed essentially as shown, with step 494 setting the appropriate indicator MFU to indicate a main-floor up call for the bank at which the call was registered.

Figure 8:
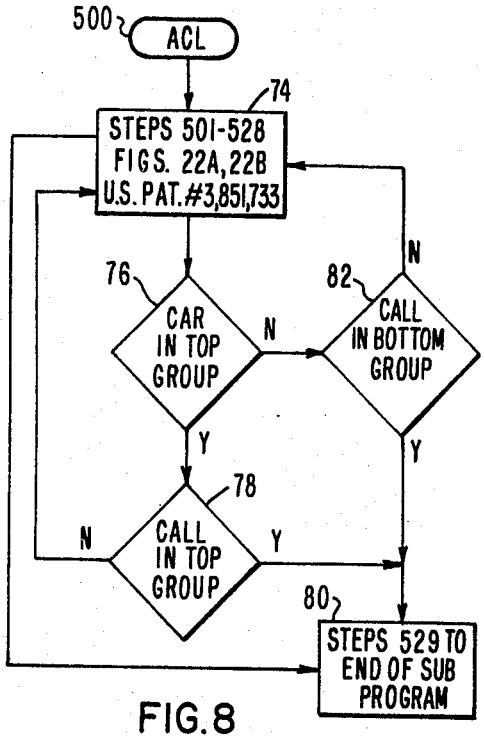
FIG. 8 is a flow chart which illustrates how sub-program ACL of U.S. Pat. No. 3,851,733 may be modified according to the teachings of the invention.

FIG. 8 sets forth certain modifications made to sub-program ACL shown in FIGS. 22A, 22B and 22C of the incorporated patent. Sub-program ACL, as hereinbefore stated, attempts to allocate a hall call to a suitably conditioned busy car. Sub-program ACL is entered at terminal 500, and steps 501–528 are followed, as shown generally at 74. Step 76 then checks to see which bank of cars the busy elevator car being considered is a member of. If step 76 finds the car is from the bank which serves the top group of floors, step 78 checks to see if the call being considered is from the top group. If it is, the remainder of the program ACL may be followed, as indicated at 80. If step 78 finds the call is from the bottom group, the program returns to step 74 to consider another car. If step 76 finds the busy car which is being considered serves the bottom group, step 82 checks to see if the call is from the bottom group. If it is, the program advances to the steps shown generally at 80. If it is not, the program returns to 74 to consider another busy car.

Figure 9:
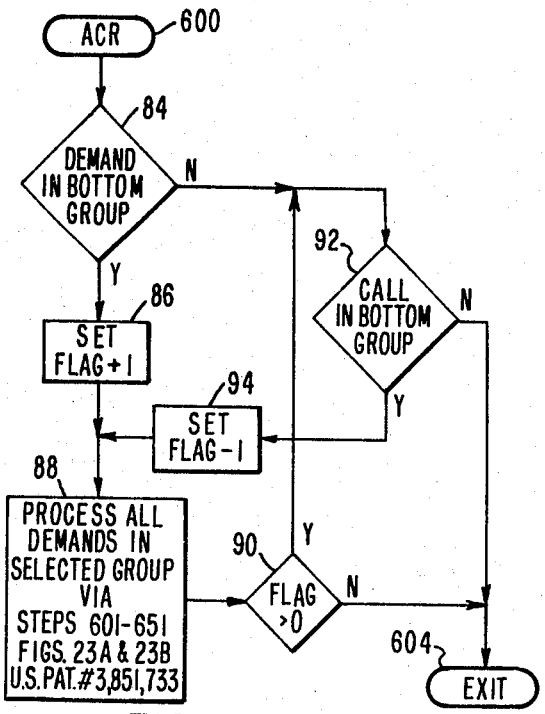
FIG. 9 is a flow chart which illustrates how sub-program ACR of U.S. Pat. No. 3,851,733 may be modified according to the teachings of the invention.

FIG. 9 sets forth certain modifications made to sub-program ACR shown in FIGS. 23A and 23B of the incorporated patent. As hereinbefore stated, sub-program ACR attempts to assign a non-busy, in-service car to a registered demand. Sub-program ACR is entered at terminal 600 and step 84 checks the words shown in FIG. 3 to see if there is a registered demand in the bottom group. If there is, step 86 sets a program flag to +1, and steps 601–651, shown generally at 88, process all registered demands in the selected group, which is the bottom group at this point of the program. Step 90 then checks to see if the flag is a +1. If it is, the demands in the top group have not yet been checked, and the program advances to step 92 which checks the words shown in FIG. 4 to see if there is a registered demand in the top group. If step 84 found no demand in the bottom group, it would also advance to step 92. If a demand is found, the program flag is set to −1 and the steps shown generally at 80 would process the demands in the top group. Step 90 will now find that the flag is not greater than zero, and the program exits at 604. If step 92 found no demand in the top group, it would also proceed to terminal 604.

Figure 10:
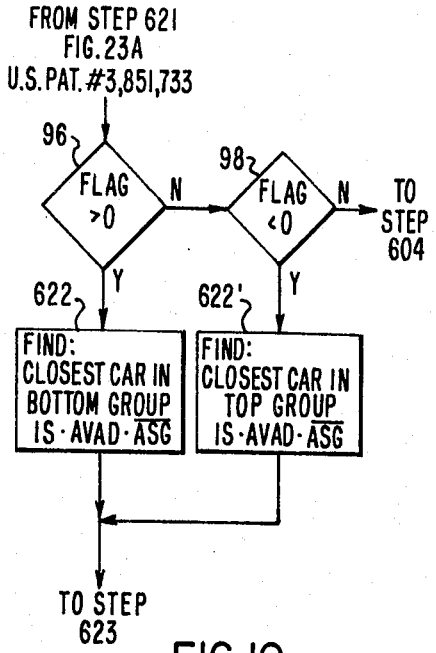
FIG. 10 is a portion of a flow chart which illustrates a modification which may be made to sub-program ACR shown in FIG. 9.

FIG. 10 illustrates the use of the program flag in sub-program ACR. After step 621 in FIG. 23A of the incorporated patent, step 96 would check the flag to see if it is greater than zero. If it is, the demand is in the bottom floor group, and step 622 would attempt to find the closest car in the bank which is associated with the bottom group, which is in service (IS), available for assignment (AVAD), and not assigned ($\overline{ASG}$). The program then proceeds to step 623. If step 96 finds the flag is not greater than zero, step 98 checks to see if it is less than zero. If it is, step 622′ attempts to find an available car in the bank of cars which serves the top group. Step 96 could proceed directly to step 622′, since if the flag is not greater than zero, it should be less than zero, as set forth in FIG. 10. However, the disclosed arrangement will provide a program check to ensure that a floor group has, indeed, been selected. If step 98 finds the flag zero, for some reason, the program would advance to the exit terminal 604. The modification set forth in FIG. 10 would also be added to FIG. 23B of the incorporated patent, following step 640.

Figure 11:
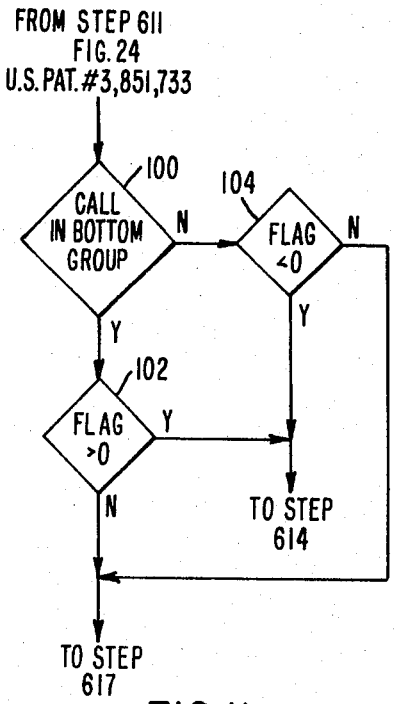
FIG. 11 is a portion of a flow chart which illustrates a modification which may be made to sub-routine LOOK of U.S. Pat. No. 3,851,733.

Step 608 in FIG. 23A of the incorporated patent refers to a sub-routine LOOK, which is set forth in FIG. 24 of the incorporated patent. FIG. 11 of the present application illustrates how sub-routine LOOK would be modified according to the teachings of the invention. Sub-routine LOOK scans the call table to find a call which has triggered the type of demand being processed. Step 611 of the incorporated patent proceeds to step 100 in FIG. 11 to check each call as to its associated floor group. If the call is in the bottom group, step 102 checks to see if the demands from the bottom group are being processed. If they are, the flag will be greater than zero, and the program advances to step 614 to further process this call. If the call is in the bottom group and the program is processing demands from the top group, step 102 proceeds to step 617 to examine the next call in the call table.

If step 100 found the call to be from the top group, step 104 checks to see if demands from the top group are being processed. If they are, step 104 proceeds to step 614, to further process the call. If they are not, step 104 proceeds to step 617 to examine the next call in the call table.

In summary, there has been set forth a new and improved method of operating an elevator system, by independently applying a total strategy package to more than one group of floors in a building, which brings the full dispatching force of the strategy to each floor group, as opposed to prior art arrangements in which floor groups would be treated as zones of the strategy. Further, this method adds little to the cost of the elevator system, as it utilizes a single system processor, a single hall call control, and a single data transmission system. All necessary changes are easily incorporated into the elevator system, because they are software changes, and even these changes are minimal considering the improvement in elevator service such a method may bring to certain building configurations.

I claim as my invention:

1. A method of serving calls for elevator service in a building having a plurality of floors, including a main floor, and a plurality of cars for serving the floors, comprising the steps of:

providing a single system processor having a single predetermined strategy for serving calls for elevator service which includes the steps of dividing the floors of a building into a predetermined plurality of zones of contiguous floors, according to the locations of the floors relative to the main floor, and service directions from the floors, and increasing the number of zones in the building, beyond the predetermined plurality, by the steps of:

(a) dividing the building into first and second groups of contiguous floors, (b) assigning certain of the elevator cars to serve only the first group, certain of the elevator cars to serve only the second group, and all of the cars to serve the main floor, and (c) applying the single predetermined strategy of the single system processor to each of said first and second groups of floors independently, such that each group is effectively treated as a separate building, with each being served by the complete strategy, as opposed to being treated as separate zones of a common strategy.

2. The method of claim 1 including the steps of:

providing means for registering up and down hall calls from the floors of the first and second groups, collecting the up and down hall calls in hall-call control means common to both the first and second groups, and separating, in the single predetermined strategy, the up and down hall calls according to the first and second groups.

3. The method of claim 2 wherein the step of collecting the up and down hall calls includes the step of serializing the up and down hall calls in common up-call and common down-call serial streams.

4. The method of claim 2 wherein the step of separating the up and down hall calls in the common strategy includes the steps of determining the group of each call, determining the floor group of each busy elevator car, and allocating a call to a suitably conditioned busy elevator car in its group.

5. The method of claim 4 including the steps of:

creating a demand for a hall call not allocated to a busy car, determining if there is a non-busy car assigned to the floor group of the demand, and assigning such a non-busy car to the demand in its floor group.

* * * * *